US009486655B1

(12) United States Patent
London, Sr. et al.

(10) Patent No.: US 9,486,655 B1
(45) Date of Patent: Nov. 8, 2016

(54) FALL ARREST SYSTEM

(71) Applicants: Joseph T. London, Sr., Stoneville, NC (US); Joseph T. London, Jr., Stoneville, NC (US)

(72) Inventors: Joseph T. London, Sr., Stoneville, NC (US); Joseph T. London, Jr., Stoneville, NC (US)

( * ) Notice: Subject to any disclaimer, the term of this patent is extended or adjusted under 35 U.S.C. 154(b) by 0 days.

(21) Appl. No.: 15/005,622

(22) Filed: Jan. 25, 2016

Related U.S. Application Data

(63) Continuation-in-part of application No. 14/226,022, filed on Mar. 26, 2014, now Pat. No. 9,242,127.

(51) Int. Cl.
*A62B 35/00* (2006.01)

(52) U.S. Cl.
CPC ..... *A62B 35/0018* (2013.01); *A62B 35/0037* (2013.01)

(58) Field of Classification Search
CPC ..... A62B 35/0018; A62B 35/0037
See application file for complete search history.

(56) References Cited

U.S. PATENT DOCUMENTS

| | | | | |
|---|---|---|---|---|
| 1,690,720 | A * | 11/1928 | Cosby | A62B 1/14 188/65.3 |
| 1,716,997 | A * | 6/1929 | Antoniow | B66C 1/36 24/599.5 |
| 1,723,028 | A | 8/1929 | Friedman | |
| 2,627,638 | A * | 2/1953 | Pinson | A44C 5/2038 24/599.5 |
| 3,956,804 | A * | 5/1976 | Gatof | A44C 5/2038 24/598.5 |
| 4,923,048 | A | 5/1990 | Cole | |
| 4,991,689 | A | 2/1991 | Cole | |
| 5,438,796 | A * | 8/1995 | Nathan | A01G 9/006 47/66.6 |
| 6,405,685 | B1 | 6/2002 | Cox | |
| 8,128,141 | B2 | 3/2012 | Chen | |
| 8,353,386 | B2 | 1/2013 | Helms | |
| 8,534,626 | B1 * | 9/2013 | Freese | A47G 29/083 24/376 |
| 8,826,469 | B2 | 9/2014 | London | |
| 2002/0046448 | A1 * | 4/2002 | Camaiani | A44C 5/20 24/599.8 |
| 2008/0179136 | A1 | 7/2008 | Griffith | |
| 2012/0170873 | A1 | 7/2012 | Mathews | |
| 2012/0210542 | A1 * | 8/2012 | Yang | F16B 21/165 24/369 |

FOREIGN PATENT DOCUMENTS

| | | | |
|---|---|---|---|
| EP | 1 222 004 | 10/2000 | |
| WO | WO 2014088603 A1 * | 6/2014 | A62B 35/0037 |

OTHER PUBLICATIONS

ANSIZ359 (American National Standards Institute Fall Protection Guidelines, version Z359.1-2007, approved May 31, 2007 and effective Nov. 24, 2007).

* cited by examiner

*Primary Examiner* — Alvin Chin-Shue
(74) *Attorney, Agent, or Firm* — Blake P. Hurt; Tuggle Duggins P.A.

(57) ABSTRACT

A personal fall arrest system including a safety harness with a tie-off point low at the back and elastomeric bands at the leg apertures to protect the femoral arteries of a wearer in the event of a fall. The system also includes an energy-absorbing lanyard contained within a cover and connected on opposing ends to a pair of non-conductive self-closing and self-locking hooks.

10 Claims, 9 Drawing Sheets

FALL ARREST SYSTEM

This is a Continuation-In-Part application of and claims benefits under pending prior application Ser. No. 14/226,022, filed 26 Mar. 2014, now U.S. Pat. No. 9,242,127, which is incorporated by reference in its entirety herein.

FIELD OF THE INVENTION

The invention herein pertains to a fall arrest system and particularly pertains to a personal safety system including a two-piece knitted body harness designed to reduce trauma to the body and femoral arteries of a wearer, an elastic and nylon knitted anchoring lanyard, and a pair of self-closing and self-locking non-conductive hooks affixed at opposing ends of the lanyard.

DESCRIPTION OF THE PRIOR ART AND OBJECTIVES OF THE INVENTION

Personal fall arrest systems (PFAS) are common in industries such as window washing, roofing, tree trimming, arboring and other lumberjack activities, utility installers, construction, and others in occupations where dangers associated with a fall greater than six feet (6') are part of the job. Typically, these systems comprise a series of straps or a vest worn by a user and a length of lanyard attached to a secure base structure, usually with a clasp or hook. Other equipment such as body belts, window cleaner belts, and chest harnesses may also be employed by elevated professionals, but these are not typically construed as full PFASs given their various limitations.

In addition to PFAS failure, one of the greatest dangers to working at heights and falling is the restriction of blood flow following arrest. Studies have shown that the force impacted on the body of a user of a conventional, strap-style safety harness (for example, see U.S. Pat. No. 8,353,386 to Helms) can exceed five thousand pounds (22.2 kN) of force. In addition to the restrictive impact on bones, muscles, and other soft tissues, strap-style harnesses are known to significantly reduce blood flow, particularly through the femoral arteries due to the angle of hang, the length of time hanging, and the body weight restrained by the straps.

Thus, in view of the problems and disadvantages associated with prior art devices, the present invention was conceived and one of its objectives is to provide a personal fall arrest system (PFAS) that significantly reduces blood flow restriction (less than 5% reduction in blood flow) during a fall and hang.

It is another objective of the present invention to provide a two-piece safety harness knitted with up to one thousand (1000) denier polymeric material.

It is still another objective of the present invention to provide a safety harness that defines openings for the arms and legs of a user, such that the harness may be considered a "full body" harness.

It is yet another objective of the present invention to provide a PFAS that suspends the body of a wearer in a substantially horizontal position and does not exceed a sixty degree (60°) vertical angle during arrest.

It is a further objective of the present invention to provide a safety harness with a locking zipper slider positioned on the front of the harness.

It is still a further objective of the present invention to provide a safety harness with a tie-off point longitudinally positioned on the back proximate and below the arm openings of the harness.

It is yet a further objective of the present invention to provide a safety harness with a pair of leg cuffs, each defining a tubular structure for receiving an elastomeric strap therein and positioned about different ones of the leg openings in the harness.

It is another objective of the present invention to provide a PFAS with an energy-absorbing lanyard totaling two thousand seven hundred eighty (2780) denier formed from two nylon runs (840 denier each) twisted around a spandex core (1100 denier).

It is a further objective of the present invention to provide a lanyard cover formed from nine hundred thirty (930) denier nylon.

It is still a further objective of the present invention to provide one or more non-conductive hooks positioned at opposing ends of the lanyard to secure the PFAS wearer to an anchored position during use.

It is yet a further objective of the present invention to provide a self-closing and self-locking non-conductive hook comprised of a spring, a latch, and a trigger.

It is another objective of the present invention to provide a PFAS that is lightweight, easy to use without assistance, and inexpensive to manufacture and sell.

Various other objectives and advantages of the present invention will become apparent to those skilled in the art as a more detailed description is set forth below.

SUMMARY OF THE INVENTION

The aforesaid and other objectives are realized by providing a personal fall arrest system (PFAS) including a knitted safety harness with identical right and left sections formed into front and rear sections stitched together with one or more vertical locking zig-zag rows oriented longitudinally relative to the harness at the front and back, respectively, and laterally at the harness top and bottom, respectively. The body of the harness is formed from a series of perpendicularly oriented straps that are integrated into the knitted harness such that there are no seams between the straps and the harness body. A pair of tubular cuffs are positioned around different ones of a pair of leg openings or apertures and are each sized to receive an elastomeric strap therein to hold leg openings open during donning and to soften the impact on the femoral arteries of a harness wearer during a fall. The PFAS also includes an energy-absorbing lanyard formed from a double-covered spandex wrapped in high tenacity nylon yarn. The lanyard is inserted into a durable cover and a pair of non-conductive hooks are affixed at opposing ends. Each hook includes a pair of springs biasing a trigger release and a latch, so that each hook is self-closing and self-locking.

DETAILED DESCRIPTION OF THE PREFERRED EMBODIMENT AND OPERATION OF THE INVENTION

Figure 1:
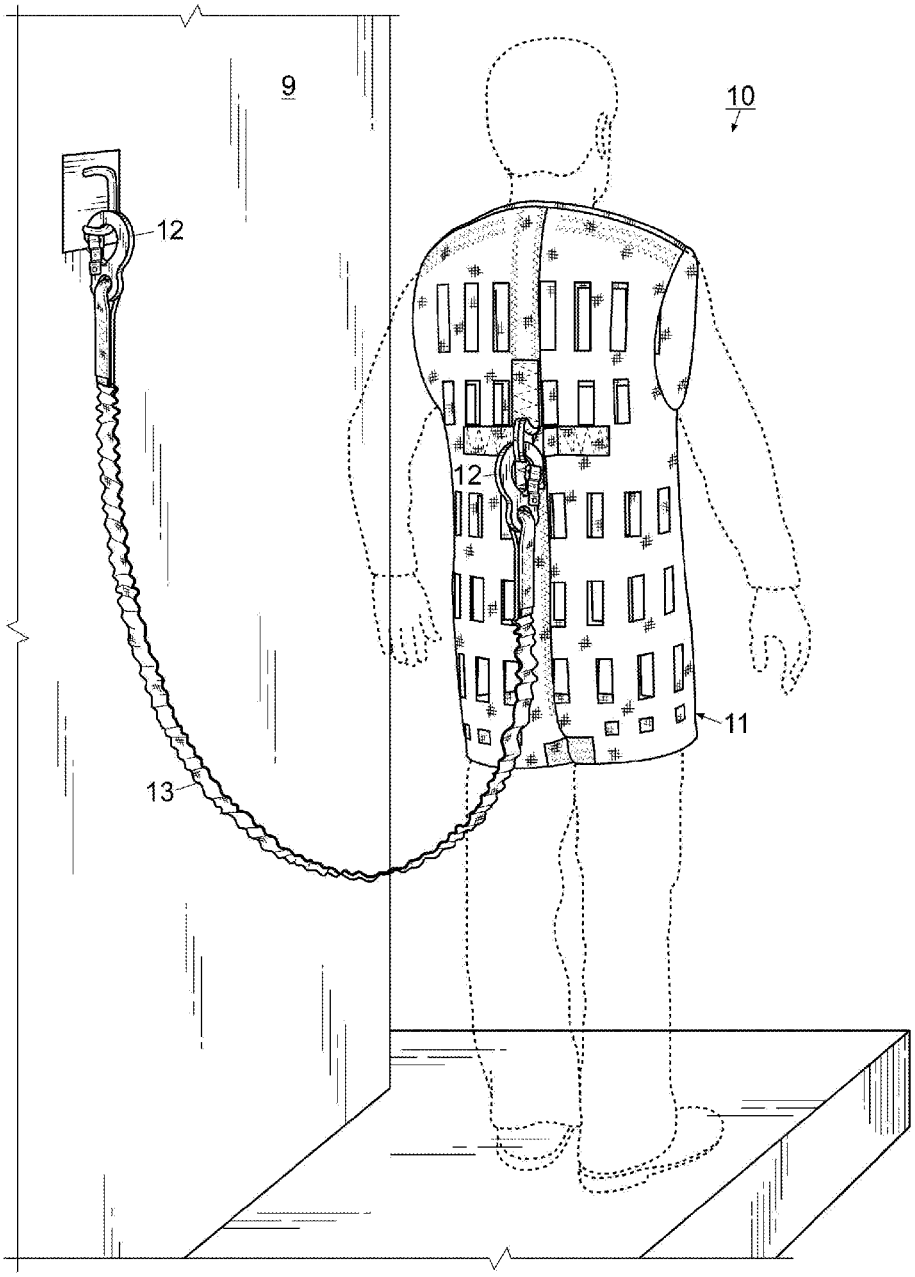
FIG. 1 shows a rear perspective view of a personal fall arrest system in use.

For a better understanding of the invention and its operation, turning now to the drawings, FIG. 1 illustrates personal fall arrest system 10 (PFAS) as utilized by a user represented in ghost fashion. Preferable PFAS 10 includes safety harness 11, lanyard 13, and a pair of hooks 12. As shown in FIG. 1, the typical user of PFAS 10 may be concerned from falling from an elevated height during use, for example a utility worker, hunter, lumberjack, or the like. System 10 uses one of hooks 12 of lanyard 13 to secure harness 11 to anchor point 9 with the other hook 12 attached to tie-off loop 28, such that if a user were to fall, lanyard 13 and harness 11 would serve to arrest the user's descent without causing trauma to the user's bones, internal organs, or blood vessels.

Figure 2:
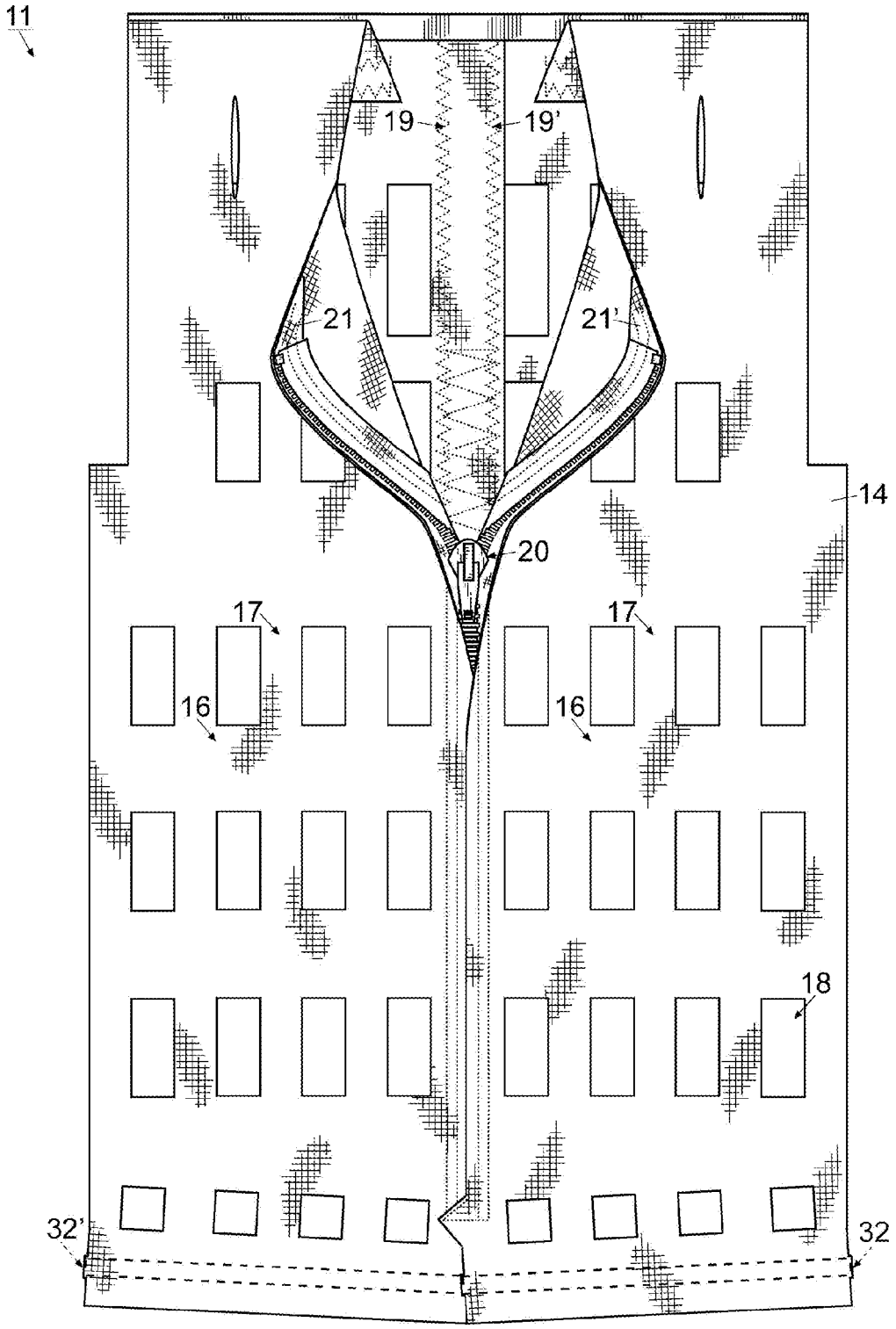
FIG. 2 pictures a front elevated plan view of the safety harness of FIG. 1.
Figure 3:
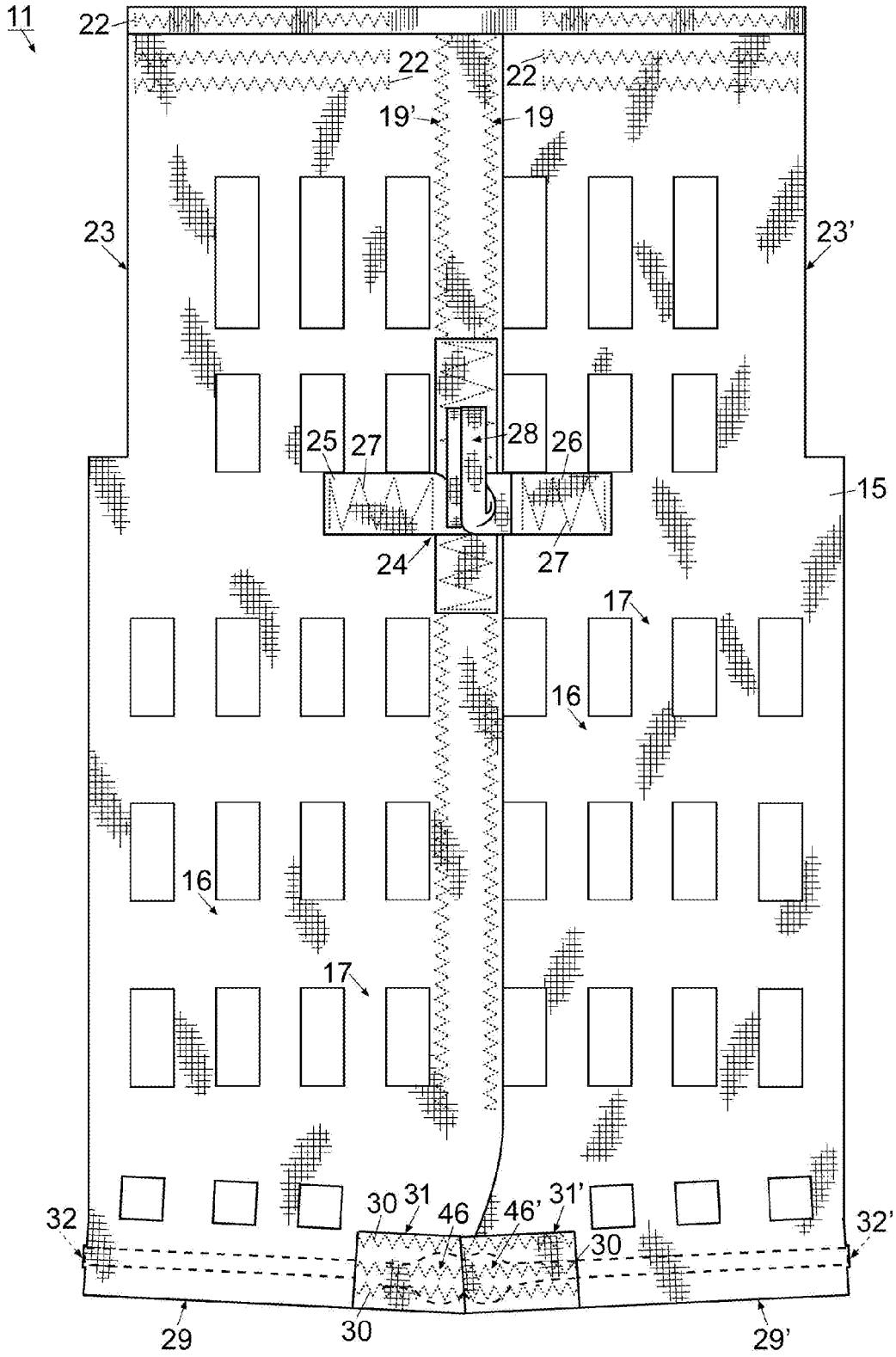
FIG. 3 depicts a rear elevated plan view of the safety harness of FIG. 1.

As displayed in FIGS. 2 and 3, safety harness 11 defines front section 14 and rear section 15 separated into left and right portions by zipper 20. Although harness 11 may be assembled from any number of sections, including a single integrated construction (i.e. one piece), preferred safety harness 11 is formed from two (2) pieces of material. As shown in FIG. 1, harness 11 is considered a "full body" harness in that harness 11 secures both the arms and legs of a user during use and is put on for example like a jumpsuit. Harness 11 may be formed on a flat bed knitting machine using materials such as nylon, polyester, or Nomex_yarns at eight hundred forty to one thousand (840-1000) denier. Front section 14 and rear section 15 may be knitted by any conventional weaving method known in the art, but preferred harness 11 is constructed using a weft-knitting interlock method for added structural stability as well as allowing cushioning give during a fall. Harness 11 is easy to put on, light in weight and can be worn continuously as it provides a body cooling design as described in further detail herein. Harness 11 also orients the body of a user at greater than a thirty degree (30°) angle but less than a sixty degree (60°) angle from vertical during suspension following a fall.

Front section 14 and rear section 15 each include a plurality of laterally oriented "horizontal" straps 16 and longitudinally oriented "vertical" straps 17. The terminology identifying straps 16 and 17 is not intended to be limiting but instead is used to clarify the substantially perpendicular relationship between straps 16 and 17, respectively. Horizontal straps 16 and vertical straps 17 may be woven above and below one another, stitched together at respective intersections, or adhered in any other fashion, such as with the use of adhesives but preferably are integrally formed (for example, continuously knitted or otherwise considered "monolithic") at the junctions of respective horizontal straps 16 and longitudinal straps 17 during the knitting of front section 14 and rear section 15, reducing potential stress points at the seams. These preferred straps 16 and 17 define a series of rectangular openings 18 in the surface of harness 11 that prevent overheating and allow for flexibility and quick drying during use.

Front section 14 and rear section 15 may be attached together with any method but preferably are sewn together at the back with two longitudinal rows of locking zig-zag stitches 19, 19'. The locking stitch pattern used throughout PFAS 10 is not a mere design choice and imparts additional stitches per unit measurement (for example, per square inch) that strengthens the structural integrity of system 10, as well as being engineered to "give" in the event of a fall, such that some number of stitches may absorb a given measurement of stress before releasing the stitch, increasing the likelihood that the remaining stitches will hold. Front section 14 also includes locking zipper 20 and locking slider (not shown) that are affixed to front section 14 with two rows of straight locking stitches 21, 21'.

Although not illustrated in FIG. 2, embodiments of harness 11 may include optional features such as secondary tie-off points, pockets, tool loops, and in the case of a more secure vest, sleeves (not shown). PFAS 10 may also come in a variety of sizes to accommodate users of different sizes, sexes, and shapes as well as colors to correspond to the preference of the user. Further, the harness can be produced with special chemical resistance and fire proof qualities such as for fire fighters, welders or the like or can include reflective materials such as in safety vests.

Rear harness section 15 as seen in FIG. 3 is similar in many respects to front section 14 but also includes unique features. The top portions of front section 14 and rear section 15 are attached together, preferably with stitching, by three rows of zig-zag locking stitches 22. Harness 11 defines arm apertures 23, 23' near the top of the harness, allowing the user to extend arms therethrough as would be understood. As seen in FIG. 3, tie-off point 24 is formed in the center of harness 11 with a pair of tie-off straps 25, 26 which form a perpendicular orientation and is located proximate arm apertures 23, 23', which is to say tie-off point 24 is positioned longitudinally "below" arm apertures 23, 23', resulting in tie-off loop 28 being positioned much lower on the back of a wearer than a traditional D-ring (not shown), leading to the previously described, advantageous hang angle.

Tie-off point 24 is preferably formed by positioning and affixing strap 25 horizontally flat against rear section 15 proximate arm opening 23 whereby it meets strap 26 in the center and a section is folded in half thereunder to form loop 28. Thereafter strap 25 is then curved under itself to extend downwardly for flat vertical placement and attachment against rear section 15. Strap 26 is positioned horizontally flat against rear section 15 proximate arm opening 23' and upon meeting strap 25, a section is folded in half thereover whereby the folded side edges of strap 25 are within the fold of strap 26 to assist in forming loop 28. Thereafter strap 26 is curved to extend upwardly for flat vertical placement and attachment against rear section 15. Additional stitching along the curved, folded sections of straps 25, 26 will maintain their folded posture and increases the structural integrity of loop 28.

Both straps 25, 26 are stitched along the flat portions onto rear section 15 with zig-zag locking stitches 27. Loop 28 is sized to receive one of hooks 12 such that, in the event of a fall, a user of PFAS 10 may be suspended by loop 28. A tag (not shown) may be attached to loop 28 such that during a fall, the force applied thereto would cause the tag to extend and become visible such that a PFAS that has been subjected to the stress of a fall will not be used again.

Preferred harness 11 also defines a pair of leg apertures 29, 29' at the vest end opposing arm apertures 23, 23'. Each of leg apertures 29, 29' may include two inch (2") tubular cuff 31, 31' positioned proximate the harness 11 inseam and affixed with three rows of zig-zag locking stitches 30. Cuffs 31, 31' cover respective tubular openings 46, 46' which are sized to respectively receive elastomeric bands 32, 32' therein. Elastomeric bands 32, 32' serve to maintain leg apertures 29, 29' in an open configuration while a user puts on harness 11. Bands 32, 32' are also sufficiently deformable such that when a user experiences a fall and is supported only by PFAS 10, leg apertures 29, 29' do not constrict blood vessels to the degree previously known in the art. For example, a sonographic test was conducted of the left superficial femoral artery to measure blood velocity at rest, immediately following a fall, and after two minutes of hanging. After experiencing a small decrease in blood velocity after a fall, a wearer of a conventional 6-way safety harness as is known in the art experiences a forty-four point seven percent (44.7%) decrease in blood flow through the femoral artery after two minutes of hanging. By comparison, a PFAS 10 wearer experiences no blood velocity loss immediately following a fall, and only a two point six percent (2.6%) reduction in blood flow after two minutes of hanging suspended. The health implications resulting from these tests clearly indicate that the PFAS 10 is a superior personal fall arrest system to the prior art. For example in prior art arrest systems, restriction in this area can cause suspension trauma, which can lead to blood clots and death. In the event of a fall using the PFAS 10, force is distributed over a much greater portion of the wearer's body and rather than being held upright as is conventional, PFAS 10 allows for a substantially angled position so that there is minimal restriction on the femoral arteries due to the angle of hang and weight distribution on the torso.

Figure 4:
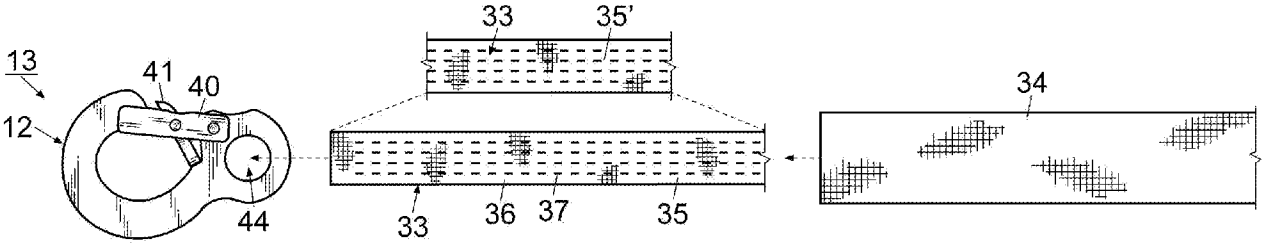
FIG. 4 demonstrates a side exploded plan view of the lanyard and hook of FIG. 1.

FIG. 4 demonstrates an elevated side schematic view of lanyard 13 with lanyard straps 33, 33' exploded from hook 12 and removed from cover 34. Lanyard 13 is defined by a pair of lanyard straps 33, 33' where each strap is formed by twisting a double-covered twenty-two (22) wrap per inch "Z" pattern nylon thread 35 and a double-covered thirty-two (32) wrap per inch "S" pattern nylon thread 35' with about eleven hundred (1100) denier spandex thread 36 combining to create a yarn. The resulting yarn is in excess of twenty-five hundred (2500) denier and preferably is two thousand seven hundred and eighty (2780) denier. The yarn is then knitted into lanyard strap 33, where it may form lanyard 13 by stitching to another lanyard strap 33' with two or more rows of straight locking stitches 37 (four full-length rows shown in FIG. 4) at twelve stitches per inch at twenty pounds (20 lbs) force break strength which assist to slow down the fall. Completed lanyard 13 preferably defines a length of six feet, three inches. Lanyard 13 is then inserted into energy-absorbing lanyard cover 34, looped through hook aperture 44 of hook 12, and stitched upon itself with locking zig-zag stitch 38 as shown in FIGS. 5 and 6.

Cover 34 is preferably formed from nine hundred thirty (930) denier nylon at thirty-three picks per inch and preferably defines a length greater than the length of lanyard 13, preferably one foot ten inches longer than lanyard 13, causing the formation of folds 39 along the length of lanyard 13. This increased surface area, coupled with the elastic quality of lanyard strap 33, allows for lanyard 13 to quickly arrest the descent of a PFAS 10 user without snapping the user to a halt which potentially causes severe trauma. Lanyard 13 typically comes in lengths of three feet (3') and six feet (6') that will stretch to five foot nine inches (5'9") and eight foot four inches (8'4") respectively after a fall.

Figure 5:
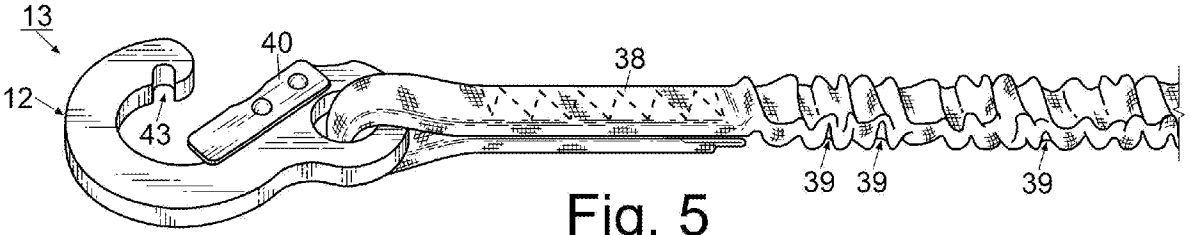
FIG. 5 illustrates a side perspective assembled view of the lanyard and hook of FIG. 4 with the hook in an open posture.
Figure 6:
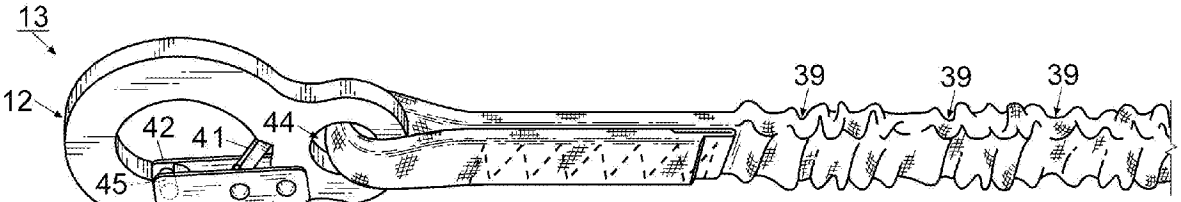
FIG. 6 features a top perspective side view of the assembled lanyard and hook of FIG. 5 with the hook in a closed posture.

FIGS. 4-6 show side and perspective views of self-closing and self-locking non-conductive hook 12. Although only one end of lanyard 13 is shown with hook 12, it is to be understood that all description applies equally to hook 12 on the opposing end of lanyard 13. Hook 12 preferably defines a generally C-shape and is formed from a non-conductive material such as S-glass composite or basalt composite fiber to reduce the risk of electrocution. Alternative embodiments of hook 12 may be formed from metal, for example aluminum, but such is not preferred as wearers of PFAS 10 are often concerned about electrical conductivity, particularly during inclement weather with respect to lightening or from electrical lines.

Figure 7:
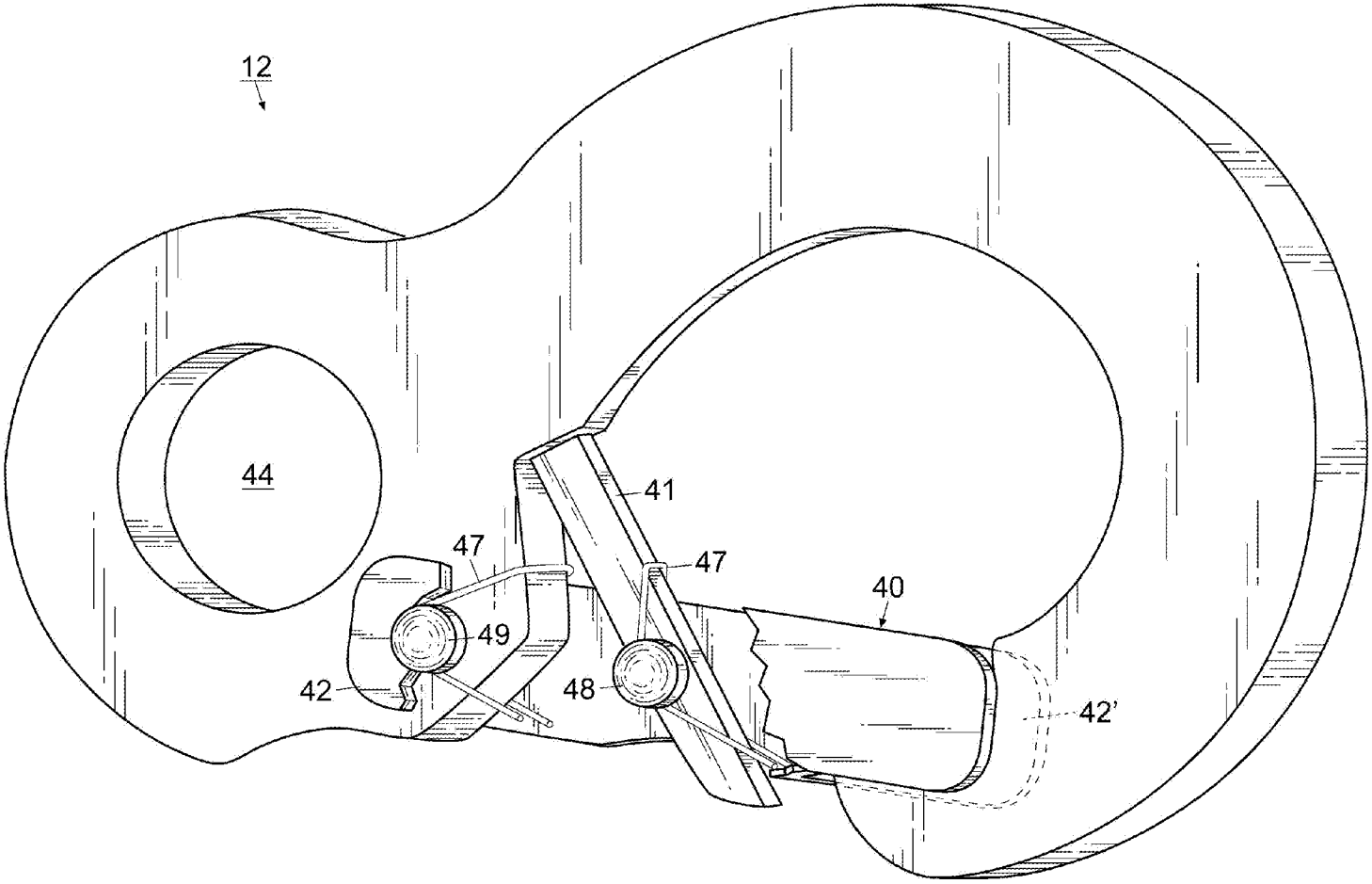
FIG. 7 shows an enlarged side perspective view of the hook of FIG. 4.

FIG. 7 illustrates hook 12 that includes latch 40 pivotally attached thereto. Latch 40 is formed from a pair of opposingly joined members 42, 42'. Each of members 42, 42' include opposing flat ends with a central U-shaped section having short side walls and a flat bottom. Members 42, 42' are joined together in opposing relation such that one pair of flat ends fit over a portion of hook 12 proximate aperture 44 and are pivotably affixed thereto such as by axle rod 49. The opposing pair of flat ends of members 42, 42' are connected via lateral latch post 45 as seen in FIG. 6 which is received within notch 43 (FIG. 5) defined in hook 12 and opposingly positioned to lanyard aperture 44 sized to receive lanyard 13. Hook 12 also includes latch trigger 41 rotatably attached to latch 40 between the flat bottomed U-shaped sections of members 42, 42' such as by axle pin 48. Both axle rod 48 and axle pin 49 are preferably two-piece, press-fit convex fasteners with powder-coated heads. This configuration allows the outer end of trigger 41 to be manually pushed towards aperture 44 whereby the opposing end of trigger 41 abutting the inside of hook 12 will pivot clockwise into the curved portion of hook 12 thus allowing the release of latch post 45 from notch 43 for opening hook 12. Latch 40 and trigger 41 are each biased by a spring 47 in the closed position and may each be formed from basalt composite. The resulting biases urge latch 40 into the closed position as a default and trigger 41 into a locked position such that hook 12, without any external influence, is a self-closing and self-locking hook.

Guidelines governing personal fall arrest systems include ANSI 2359 (American National Standards Institute Fall Protection Guidelines, version. Z359.1-2007, approved 31 May 2007 and effective 24 Nov. 2007), incorporated by reference in its entirety herein, as well as being produced by CSA (Compliance, Safety, Accountability) and OSHA (Occupational Safety & Health Administration). For example, ANSI Z359 stipulates that a lanyard hook most exhibit a pull strength of at least five thousand pounds (5000 lbs). Hook 12, by virtue of non-conductive materials and a planar as opposed to cylindrical design, has shown with testing to possess a pull strength in excess of sixty-eight hundred pounds (6800 lbs). Harness 11 has also exhibited a reduction in fall force experienced during arrest in drop testing to less than five hundred pounds, far below the ANSI-mandated eighteen hundred pound (1800 lbs) requirement.

A method of using PFAS 10 as described is also provided. The method includes the steps of providing personal fall arrest system 10 as described above, unzipping zipper 20, placing leg apertures 29, 29' with respective cuffs 31, 31' around a wearer's legs, inserting a wearer's arms through arm apertures 23, 23', and zipping zipper 20 vertically until secured in the fully secured position, and securely locking zipper 20 in place such as with a locking zipper slider. Hook 12 may be attached to tie-off point 24 prior to using PFAS 10, or it may be connected, for example by the vest user or an assistant, after harness 11 is dressed. The opposing end of lanyard 13, including another hook 12, is then attached to anchor point 9 such as seen in FIG. 1. In the event additional working range is required, hook 12 may be attached to an intermediary, such as a rope (not shown) or an alternative, longer lanyard 13. Hook 12 is opened by manually depressing trigger 41 which releases latch 40 until hook 12 is secure, thereafter release of trigger 41 allows latch 40 to be urged into a closed and locked position by the bias of springs 47. In the event of a fall, lanyard 13 fully extends, releasing a sufficient amount of stitches 37 in strap 33 (FIG. 4) as are necessary to absorb the energy of the fall until the user is suspended in a substantially horizontal orientation. As discussed, this orientation allows reduced fall force trauma, stress suspension trauma, and reduced pressure on the femoral arteries and thus increased hanging time with reduced risk for arrest trauma and clot formation. Further, the construction of harness 11 allows for any two straps to be utilized during extraction.

Figure 8:
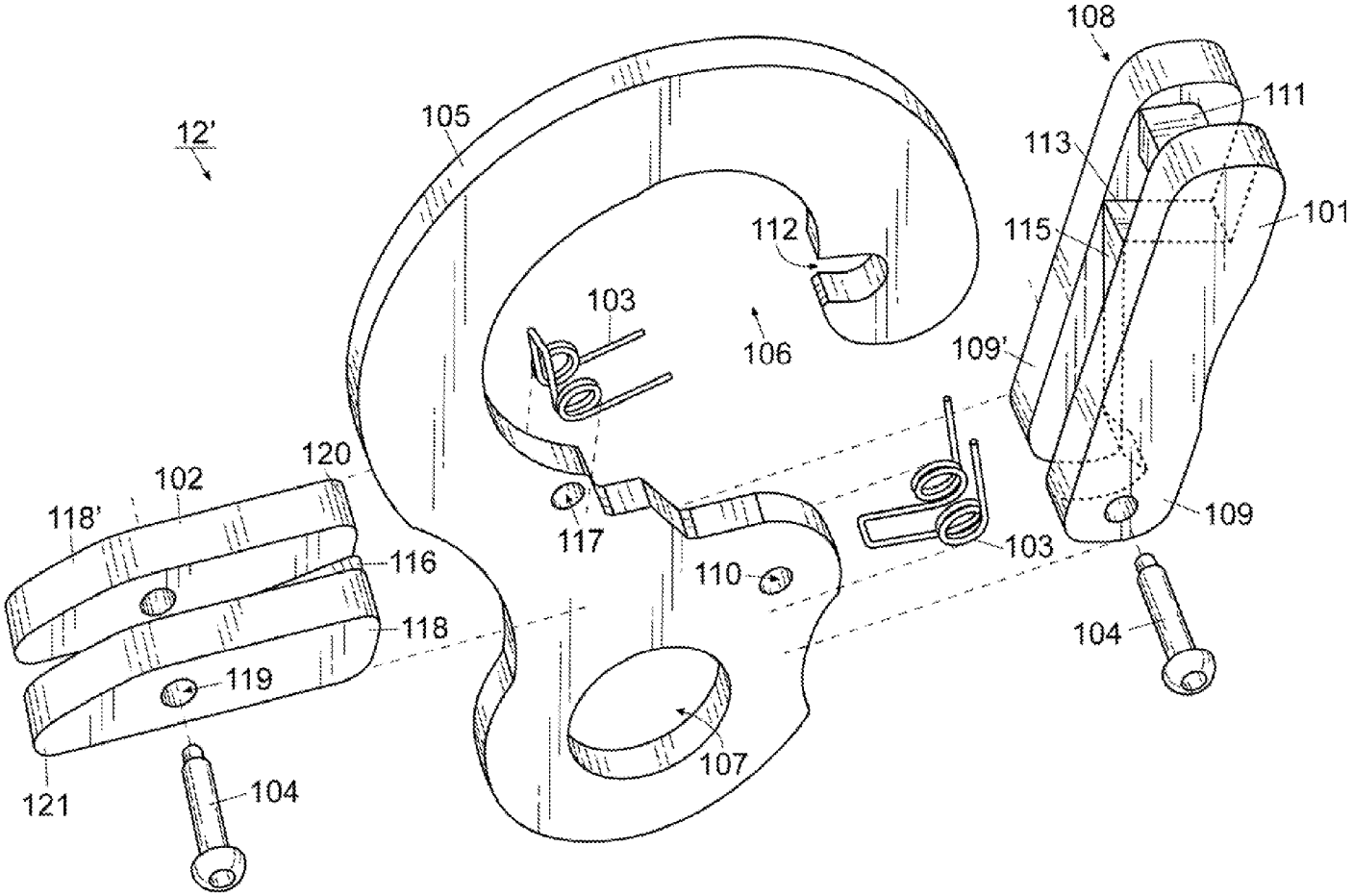
FIG. 8 pictures a side perspective exploded view of an alternate embodiment of the hook of FIG. 4.
Figure 9:
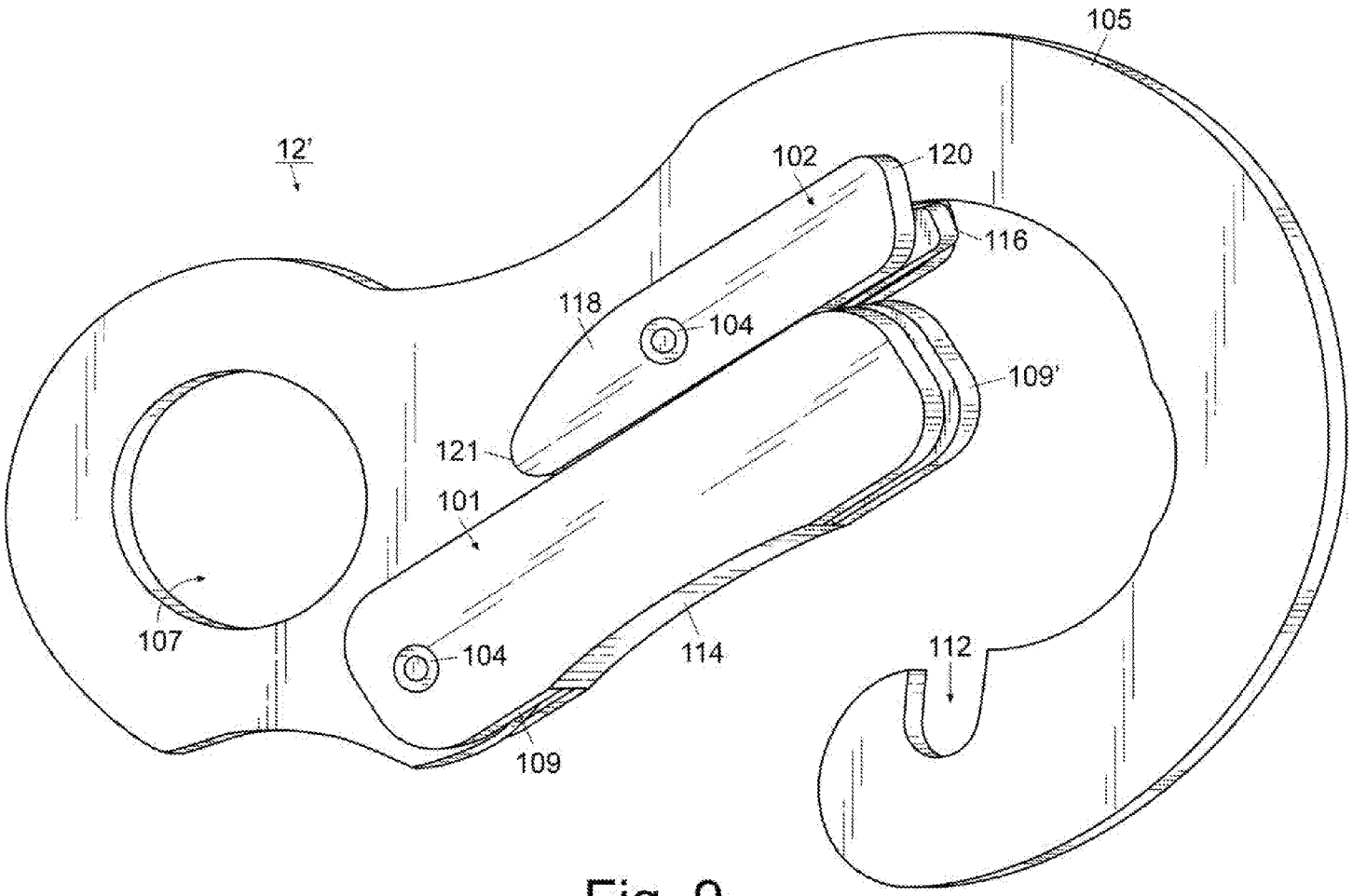
FIG. 9 depicts a side perspective assembled view of the hook of FIG. 8 in the open posture.

An alternate embodiment of hook 12, hook 12', is illustrated in FIGS. 8 and 9. FIG. 8 displays a side perspective view of hook 12' with latch 101, trigger 102, springs 103, and axle pins 104 exploded from hook body 105. As shown in FIGS. 8 and 9, hook 12' defines hook body 105 forming a generally C-shape and is formed from a non-conductive material such as S-glass composite or basalt composite fiber to reduce the risk of electrocution. Alternative embodiments of hook 12' may be formed from metal, for example aluminum, but such is not preferred. Hook body 105 includes large upper aperture 106 and small lower aperture 107, the purposes for which will be described in further detail below. The exterior body of hook 12' defines a smooth, flat, linear edge that extends the width of hook body 105 and circumscribes the exterior of hook 12'. Best seen in FIG. 8, latch 108 is formed from a pair of opposingly oriented members 109, 109'. Each of members 109, 109' include longitudinally opposing, somewhat rounded ends with a central U-shaped depression. Members 109, 109' are joined together in parallel relation such that one pair of ends fit over a protruding portion of hook body 105 proximate aperture 110 and are pivotably affixed thereto such as by axle pin 104. The opposing pair of ends of members 109, 109' are connected via lateral latch post 111 as seen in FIG. 8 which is received within notch 112 defined in hook 12' and biased ramp 113. Ramp 113 defines a slightly arcuate and substantially planar exterior surface 114 as seen in FIG. 9 and an angular, descending, planar interior surface 115 that begins at a collinear level with members 109, 109' (i.e. the distal end of latch 101 relative hook 12') and reduces in total height (i.e. towards the proximal end of latch 101 relative to hook 12') over a distance less than the total length of members 109, 109' (shown in dotted fashion), preferably with a uniform slope over the length of ramp 113. This angled slope of ramp 113 prevents the inadvertent disengagement of trigger bolt 116 as in further detail below.

Hook 12' also includes latch trigger 102 rotatably attached to hook body 105 at trigger aperture 117 with a fastener, such as by axle pin 104. Axle pins 104 are preferably two-piece, press-fit convex fasteners with powder-coated heads. Latch trigger 102 is formed from a pair of opposingly oriented trigger members 118, 118' which are joined by trigger bolt 116 disposed therebetween. Each trigger member 118, 118' defines a central aperture 119 and includes a more blunt, upright end 120 and a more tapered, sloped end 121. These "end" features are not mere design choices, as each configuration has a functional purpose that will be described in greater detail. Central aperture 119 aligns with trigger aperture 117 to accept axle pin 104 for rotatable attachment to hook 12' as described above. This configuration permits a portion of horizontal end 121 to extend beyond hook body 105 in the direction away from latch 101, creating an ergonomic ledge upon which a user may manually urge latch trigger 102 to pivot counterclockwise by pressing tapered end 121 in the downward direction (i.e. towards lower aperture 107) thus raising blunt ends 120 to overcome the frictional engagement between trigger bolt 116 and latch ramp 113 and allow latch 101 to be manually opened by upward (inward) pressure against exterior surface 114, to dislodge latch post 11 from notch 112. Upon release of latch 101, spring 103 urges the clockwise rotation and return of latch 101 to again engage with notch 112, whereby latch trigger 102 urged by its respective spring 103 is likewise pivoted in a clockwise direction and returns trigger bolt 116 into frictional engagement with ramp 113, to secure the closure of hook 12'.

Trigger bolt 116 is a generally rectangular member (see FIG. 9) that includes a protruding portion that extends beyond respective trigger members 118, 118' and is configured for frictional engagement with latch ramp 113. The angle of respective upright ends 120 coupled with the rounded nature of the end of trigger bolt 116 facilitates the frictional engagement with trigger bolt 116 with ramp 113, as well as the cooperative engagement of respective upright ends 120 with the flat side portions of latch members 109, 109'. The totality of this engagement results in a more structurally sound and robust closure security device than that taught by the prior art. Latch 101 and trigger 102 are each biased by springs 103 in the closed position and may each be formed from basalt composite or other rigid material such as metal. The resulting biases urge latch 101 into the closed position as a default and trigger 102 into a locked position such that hook 12', without any external influence, is a self-closing and self-locking hook.

Figure 10:
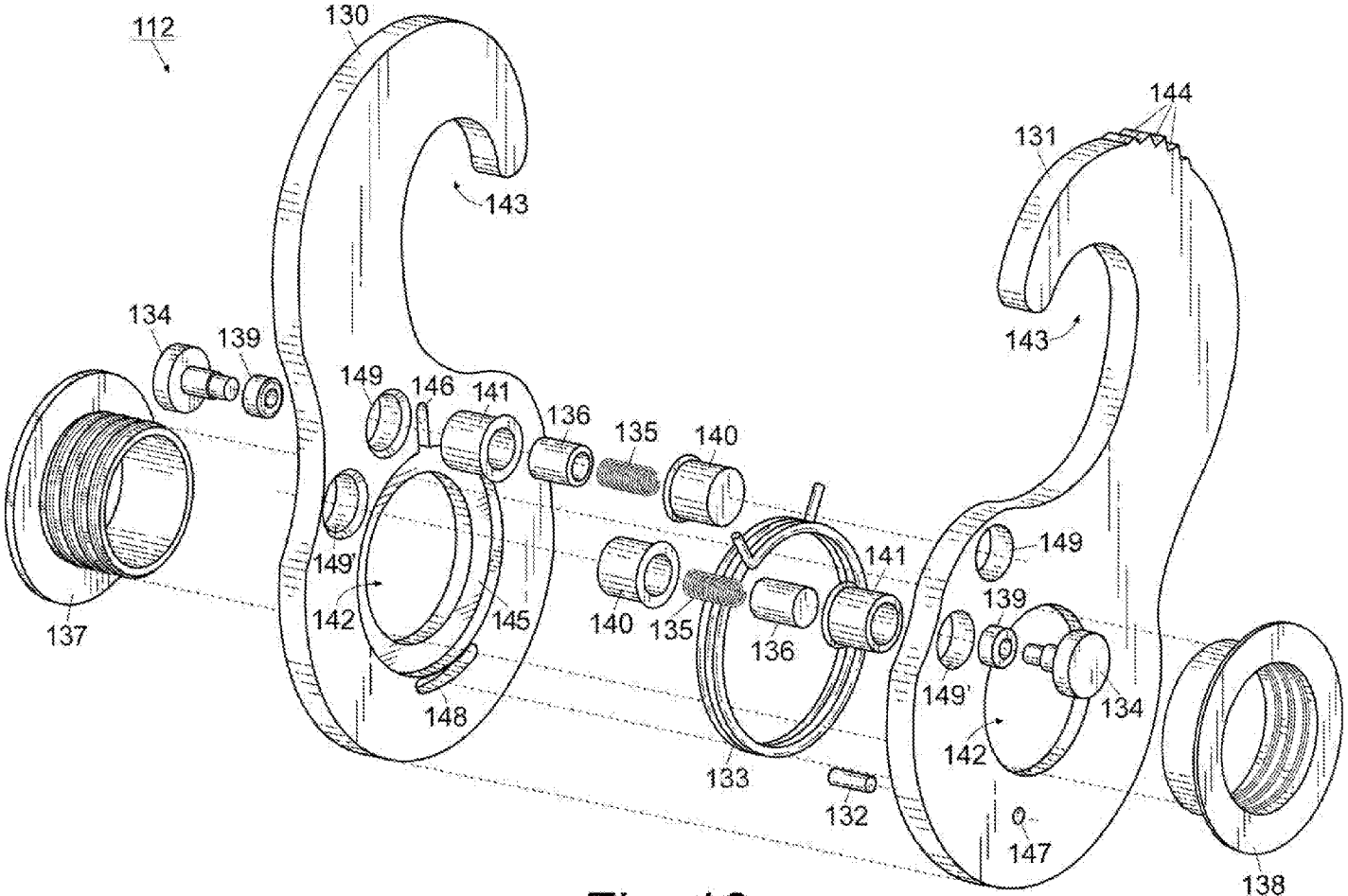
FIG. 10 demonstrates a side perspective exploded view of an alternate embodiment of the hook of FIG. 8.
Figure 11:
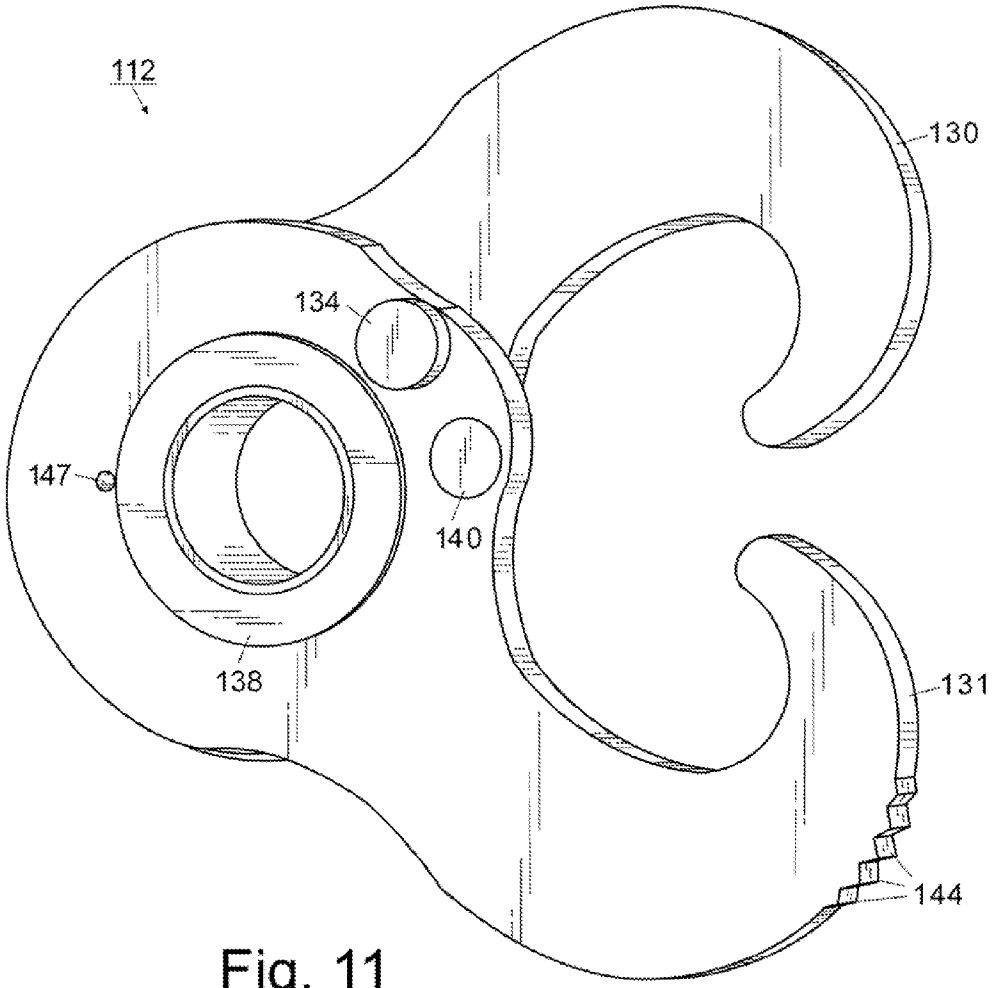
FIG. 11 illustrates a side perspective assembled view of the hook of FIG. 10 in the open posture.

An alternate embodiment of hook 12, hook 112, is shown in FIGS. 10 and 11. FIG. 10 displays a side perspective exploded view of clam-style hook 112 with male hook 130, female hook 131, restrictor pin 132, closure spring 133, pair of button pins 134, pair of springs 135, pair of locking pins 136, male pivot sleeve 137, female pivot sleeve 138, pair of threaded nuts 139, pair of spring receivers 140, and pair of button receivers 141 spaced therefrom. Male hook 130 and female hook 131 form the primary body segments of hook 112, define a shape approximating the number "6", and are preferably formed from a non-conductive material such as S-glass composite or basalt composite fiber to reduce the risk of electrocution. Alternative embodiments of hook 112 may be formed from metal, for example aluminum or steel, but such is not preferred. Male hook 130 and female hook 131 each includes large central aperture 142 for receiving male pivot sleeve 137 and female sleeve 138 therein and upper channel 143 for surrounding a mounting substrate or attachment point. The exterior body of male hook 130 defines a smooth, flat, linear edge that extends the width of male hook 130 and circumscribes a portion of the exterior of hook 112. The majority of the exterior surface of female hook 131 is similar to that of male hook 130, but further includes a plurality of serrations 144 to aid in the opening of hook 112, for example by frictionally engaging the top of female hook 131 with a clothed arm or leg surface. Male hook 130 and female hook 131 preferably each include recess 145 circumscribing central aperture 142 and defining a shoulder for the reception and seating of closure spring 133 therein. Male hook 130 further defines channel 146 in communication with recess 145 sized and shaped to receive a projection extending from closure spring 133, preferably oriented at a one o'clock position. Female hook 131 also defines a channel (not shown) in communication with recess 145 similarly sized and shaped as described above, but the channel of female hook 131 is oriented at an eleven o'clock position. It should be understood that the orientations of respective channels 146 are intended to accommodate the specific protrusions of closure spring 133 and should not be construed as a limitation. Female hook 131 may further include pin aperture 147 sized and shaped to receive cylindrical restrictor pin 132 therein. As its name suggests, restrictor pin restricts the pivotal opening range of hook 112 by traveling a short arch within passageway 148 defined by male hook 130 (see FIG. 11 for an approximation of the maximum pivoting range permitted by restrictor pin 132).

Hook 112 has at least one, and preferably two, button assemblies positioned within button apertures 149, 149' defined by male hook 130 and female hook 131, respectively. Each button assembly preferably includes button pin 134 formed from a cylinder defining a lesser diameter attached to a cylinder defining a greater diameter connected to a circular cap. Button pin 134 may carry nut 139 to broaden the contact surface in which to engage the exterior surface of locking pin 136 which protrudes through an opening in button receiver 141. The lesser diameter portion of button pin 134 and the inner opening of nut 139 may be cooperatively threaded (not shown) to further secure this frictional engagement. Locking pin 136 is a cylindrical structure in biased engagement with spring 135, and both spring 135 and locking pin 136 are positioned within an enclosure defined by spring receiver 140 and button receiver 141. The assembly is then press-fit into respective apertures 149, 149' which may include beveled interior edges circumscribing said apertures (see male hook 130, FIG. 10) to securely seat the flanged portions of button receiver 141 and spring receiver 140 therein. As should be understood, the explanation of the various components of the button assembly described above applies equally to additional button assemblies. For example, preferred hook 112 includes two button assemblies positioned in opposing position, that is to say, the respective assemblies are positioned on opposite sides of hook 112. However, the functionality of the assemblies is the same. With that said, the preferred configuration of two button assemblies is desirable as it requires depressing two separate buttons, positioned on opposing sides of hook 112, which in turn causes locking pins 136 to push against springs 135 creating outward pressure against spring receivers 140. This opposing outward pressure slightly pushes female hook 131 from male hook 130 to allow space for the movement of closure spring 133 as the respective ends thereof are squeezed together in response to the opposing movement as female hook 131 is pivoted outwardly by pressing serrations 144 against a clothed arm or leg surface to engage with and pull female hook 131 away from male hook 130 in order to open hook 112 as displayed in FIG. 11. Upon release, hook 112 returns to its closed, locked position. This orientation and operation make it much less likely that hook 112 could inadvertently open as the bias of closure spring 133 and respective springs 135 insure that hook 112 is maintained in a closed position The illustrations and examples provided herein are for explanatory purposes and are not intended to limit the scope of the appended claims.

We claim:

1. A fall arrest system comprising a knitted harness, a lanyard, and a hook, the hook attached to an end of the lanyard and including male and female members each defining a shape approximating the number "6", a male and a female sleeve positioned within respective central apertures defined by the male and female members, and a button assembly comprised of a button pin, a spring, a spring receiver, and a button receiver, the assembly positioned into corresponding button apertures defined by the respective male and female members, whereby the button assembly is depressed to open the hook; further comprising a second button assembly comprising a button pin, a spring, a spring receiver, and a button receiver, the second button assembly positioned into second button apertures defined by the respective male and female members, whereby the button assemblies are depressed to open the hook.

2. The fall arrest system of claim 1 whereby the button apertures each include a beveled edge circumscribing the apertures.

3. The fall arrest system of claim 1 whereby the female member defines a plurality of serrations thereon.

4. The fall arrest system of claim 1 whereby the hook is formed from a non-conductive material.

5. The fall arrest system of claim 1 whereby the button assemblies are oriented on opposing sides of the hook.

6. The fall arrest system of claim 1 whereby the male and female members each include a recess circumscribing the respective central apertures sized to receive corresponding male and female sleeves.

7. The fall arrest system of claim 6 further comprising a closure spring positioned within respective recesses and circumscribing the central apertures.

8. The fall arrest system of claim 7 whereby the respective recesses further define a channel sized and shaped to receive a portion of the closure spring therein.

9. The fall arrest system of claim 8 whereby one of said channels is oriented in a first position and the other of said channels is oriented in a second position, the first position different from the second position.

10. The fall arrest system of claim 1 whereby the button pins are defined by a smaller diameter cylinder attached to a larger diameter cylinder connected to a cap.

* * * * *